US005333341A

United States Patent [19]

Heneveld

[11] Patent Number: 5,333,341

[45] Date of Patent: Aug. 2, 1994

[54] ENCASED LINT ROLLER WITH COLLAPSIBLE COVER/HANDLE

[76] Inventor: William R. Heneveld, 431 Adaway Dr., Grand Rapids, Mich. 49546

[21] Appl. No.: 40,861

[22] Filed: Mar. 31, 1993

[51] Int. Cl.[5] ..... A47L 25/00; B25G 1/06

[52] U.S. Cl. ..... 15/104.002; 15/185

[58] Field of Search ..... 15/104.002, 143.1, 184, 15/185, 230.11, 427, 428, 146, 171, 244.2, 247, 248.2, 258; 492/13, 19

[56] References Cited

U.S. PATENT DOCUMENTS

| | | | |
|---|---|---|---|
| 2,423,962 | 7/1947 | Clark et al. | 15/104.002 |
| 2,542,774 | 2/1951 | Hutchinson | 15/185 X |
| 2,658,217 | 11/1953 | Green | 15/104.002 |
| 2,787,014 | 4/1957 | Barry | 15/104.002 |
| 2,852,800 | 9/1958 | Wagner | 15/258 |
| 3,192,548 | 7/1965 | Wilbrecht | 15/104.002 |
| 3,381,325 | 5/1968 | Reineman | 15/104.002 |
| 4,979,257 | 12/1990 | Heneveld | 145/104.002 |

FOREIGN PATENT DOCUMENTS

| | | | |
|---|---|---|---|
| 8301734 | 5/1983 | World Int. Prop. O. | 15/104.002 |
| 9001281 | 2/1990 | World Int. Prop. O. | 15/187 |

*Primary Examiner*—Philip R. Coe
*Assistant Examiner*—Charles Cooley
*Attorney, Agent, or Firm*—Price, Heneveld, Cooper, DeWitt & Litton

[57] ABSTRACT

A combination of a lint roller and encasement therefore in which two clam shell elements are pivotally connected together at one of their ends. One of the elements is a holder for a lint roller and the other is a cover/handle which when pivoted closed encloses the lint roller and when pivoted open serves as a handle. The two elements are each one-piece molded parts. The handle/cover element includes side sections which pivotally collapse to form a smaller and more comfortable handle in the opened use position. The holder element includes flanges extending from the end walls and between which the adhesive roller is rotatably mounted. The flanges are preferably arcuate in shape and have slanted edges providing a cam to spread the collapsed sections of the handle/cover to allow the handle/cover to fit over the roller and protect it.

20 Claims, 3 Drawing Sheets

ENCASED LINT ROLLER WITH COLLAPSIBLE COVER/HANDLE

BACKGROUND OF THE INVENTION

This invention relates to a lint roller of the type that has a tacky outer surface provided for the purpose of picking up lint, hair, dandruff, etc. from different types of surfaces such as clothing, furniture and the like. More particularly, this invention relates to such a lint roller in combination with an encasement cover, such cover providing a unique handle which can be easily gripped by the user for the purpose of operating the roller.

Lint rollers are extremely old and attempts have been made to provide some type of encasement so as to cover the tacky surface and, at the same time, provide a handle for operating the roller. Normal-size rollers have been developed with an encasement/cover of a clam shell construction which serves as the handle and which also fits over the roller. However, in such normal-size rollers, the encasement which serves as the cover is rather large and is very uncomfortable to hold. In fact, the average woman has difficulty in gripping the cover as she operates the roller. Therefore, it has become desirable to reduce the size of the handle/cover, but so far, there has been no way developed or conceived for reducing the size of the handle and still encase the roller.

SUMMARY OF THE INVENTION

In accordance with this invention, the roller holder and the encasement/cover can be opened from closed position to provide a handle that can be easily gripped. This is provided by a unique construction in which the encasement or cover is rather large in the closed state so as to cover the normal-size roller, but when opened, the cover is constructed so that it will collapse and form a smaller and more comfortable handle.

Also in accordance with my invention, I provide a unique construction for returning the collapsed sides of the cover back to the position where it fits over the entire roller and protects it so as to provide a completely encased lint roller.

Further, in accordance with this invention, a means is provided for limiting the extent of the collapsing of the sides of the handle and holding them in the collapsed state so as to provide rigidity to the handle as the operator grasps it. In addition, a means is provided for camming the collapsed sides open as the handle or clam shell is pivoted into a closed position over the roller holder.

BRIEF DESCRIPTION OF THE DRAWINGS

This invention will be described in conjunction with the drawings wherein.

DETAILED DESCRIPTION OF THE PREFERRED EMBODIMENT

Figure 2:
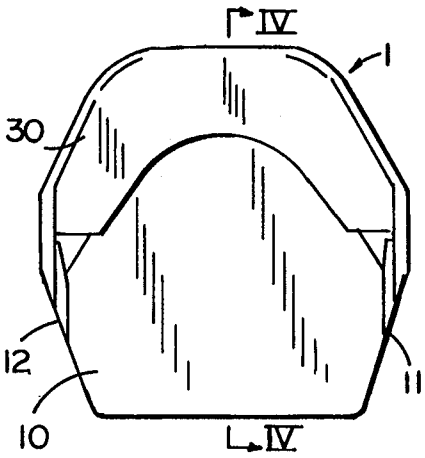
FIG. 2 is one end view of the encasement of FIG. 1.
Figure 1:
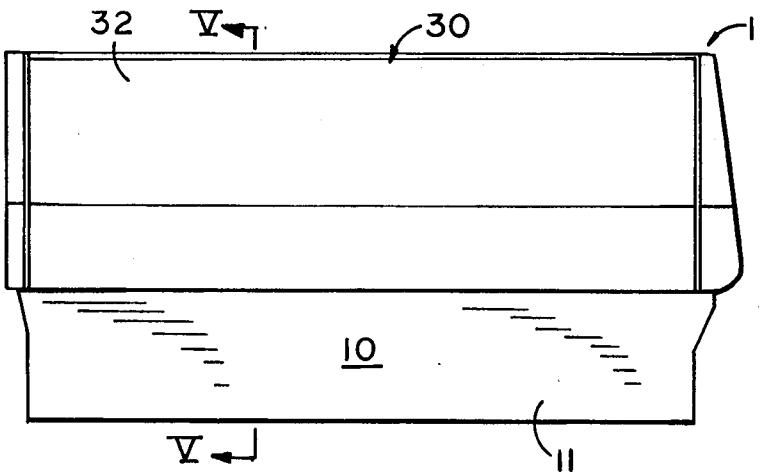
FIG. 1 is a side-elevational view of the clam shell encasement for a lint roller, such encasement being in a closed, encased position.
Figure 3:
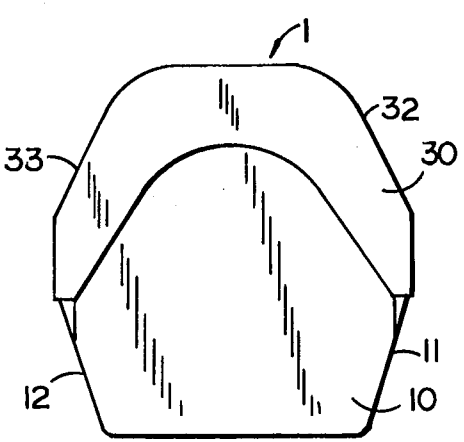
FIG. 3 is the other end view of the encasement of FIG. 1.

Referring to the drawings, reference numeral 1 designates the combination lint roller and encasement which includes three parts-the roller holder 10, the cover or handle 30 (herein referred to sometimes as cover/handle or handle/cover), and the adhesive roller 2. The holder 10 and cover/handle 30 are both molded in one piece out of a high-impact plastic material such as styrene and ABS.

The adhesive roller 2 (FIGS. 4 and &) is of a conventional type comprising a cylindrical support member 3 constructed of a cardboard-like material over which is a plurality of layers of paper coated with a tacky material 4. Roller 2 can be a cylindrical support member constructed of plastic having a tacky covering which is washable. Both of these types of lint rollers are well known and conventional. The roller has a centrally located bore extending through the entire cylinder so as to provide openings 6 and 7 at the ends of the roller.

Figure 4:
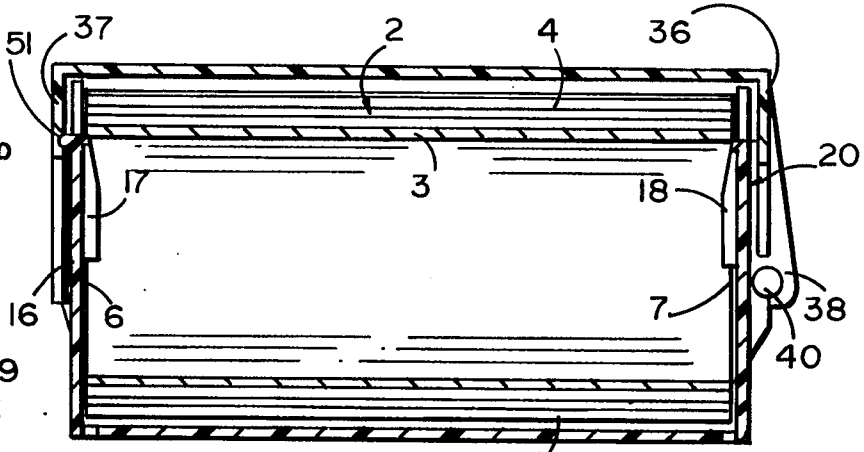
FIG. 4 is a cross-sectional view taken along the plane IV—IV of FIG. 2.
Figure 5:
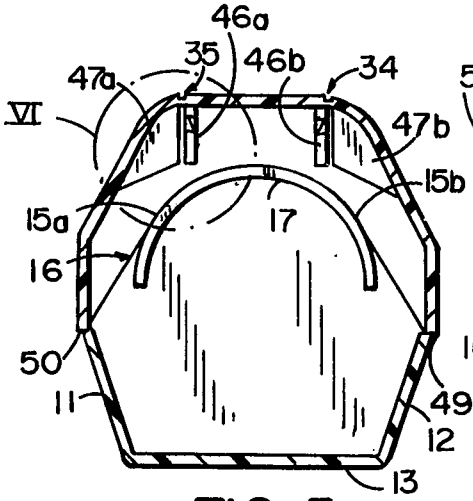
FIG. 5 is a cross-sectional view of the encasement without the roller taken along the plane V of FIG. 1.
Figure 7:
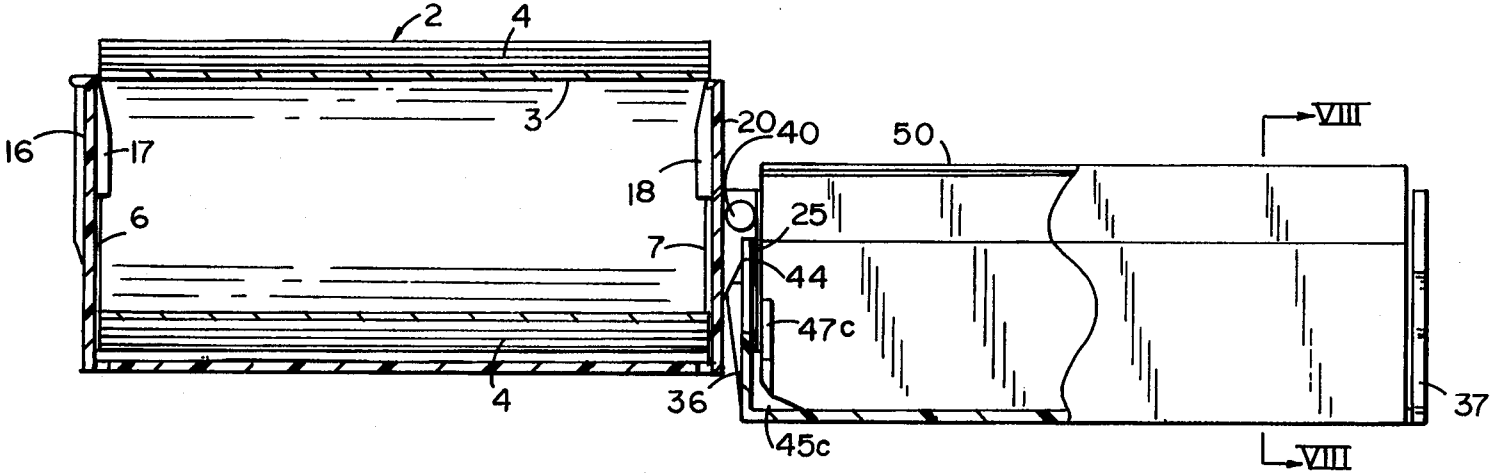
FIG. 7 is a side-elevational, cross-sectional view of the combination lint roller and encasement in the open position with the sides of the handle collapsed, a portion of the handle being unsectioned.
Figure 14:
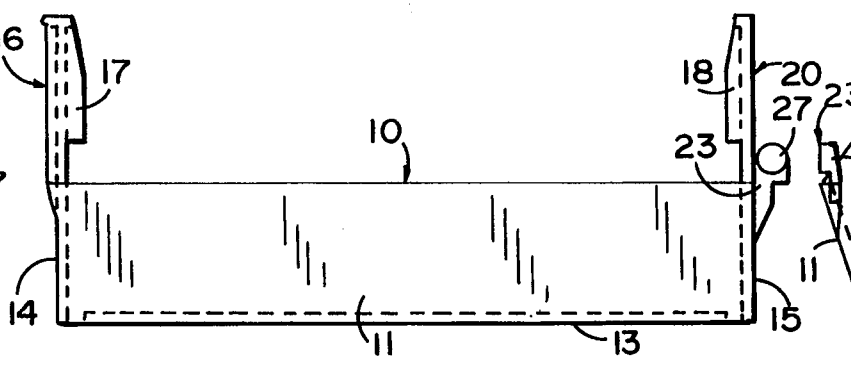
FIG. 14 is side-elevational view of the roller holder of the combination lint roller and encasement.

The roller holder or base 10 (FIGS. 14–16) is a one-piece molded part having the side walls 11 and 12. Extending upwardly from the base 13 at the end of the holder 10 are the end walls 14 and 15. Extending upwardly from the wall 14 is a disc-shaped flange 16, the end of which preferably is curvilinear in shape (FIG. 16). The flange 16 is sufficiently flexible to accommodate the roller 2 (FIGS. 4 and 7) as is described in my U.S. Pat. No. 4,979,257. The curvilinear flange 16 includes the curvilinear protrusion 17. The flange 16 is essentially of a diameter slightly less than the diameter of the adhesive roller 2 and greater than the diameter of the opening 6 of the bore of roller 2. Protrusion 17 is of a slightly less diameter than opening 6 (FIGS. 4 and 7).

At the other end of the holder 10, another flange 20 extends upwardly from the wall portion 15. It also has a protrusion 18 of substantially identical shape and dimension as the protrusion 17 of flange 16.

Flanges 16 and 20 are spaced to receive the roller 2 therebetween when flexed outwardly. They have sufficient memory to spring back into their original position for holding the roller 2 so that it can freely turn.

Holder 10 has a pair of ears 23 and 24. Each of the ears have laterally extending protrusions 26 and 27, respectively, which provide trunions on which the cover or handle 30 is pivotally mounted as will be described hereafter. Both of these ears 23 and 24 are slightly out of round at their lower portions as disclosed in FIG. 7 at 25. The purpose of the out-of-round shape is to provide a means for holding the two parts 10 and 30 in the open position as disclosed in FIG. 7.

The cover or handle 30 is a one-piece molded part comprising the central section 31 to which the sides 32 and 33 are pivotally attached by the living hinges 34 and 35 so that in the open position of FIG. 7, when one grabs the handle 30, the sides 32 and 33 collapse to form a smaller and more comfortable handle.

The cover or handle 30 includes the end panels 36 and 37 which are spaced a distance greater in dimension than the holder 10 for the purpose of receiving the holder and the flanges 16 and 20 which extend above the sidewalls 11 and 12. Cover/handle 30 has two ears 38, 39 on the end wall 36. The two ears 38 and 39 correspond to but are not identical to the shape of the ears 23 and 24. Each ear 38 and 39 has an opening 40 and 41, respectively, for receiving the trunions or pins 27 and 26, respectively. All the ears have a slight degree of flexibility and resilience so that the ears 23 and 24 can be slipped between ears 38 and 39 until the trunions 27 and 26 are aligned with openings 40 and 41 in which event the trunions snap into the openings 40 and 41.

Figure 6:
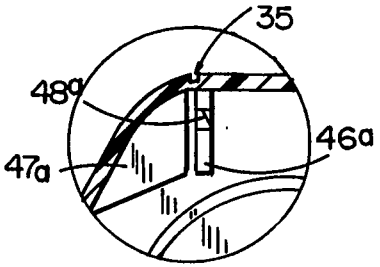
FIG. 6 is an enlarged cross section of the encircled portion of the encasement of FIG. 5.
Figure 11:
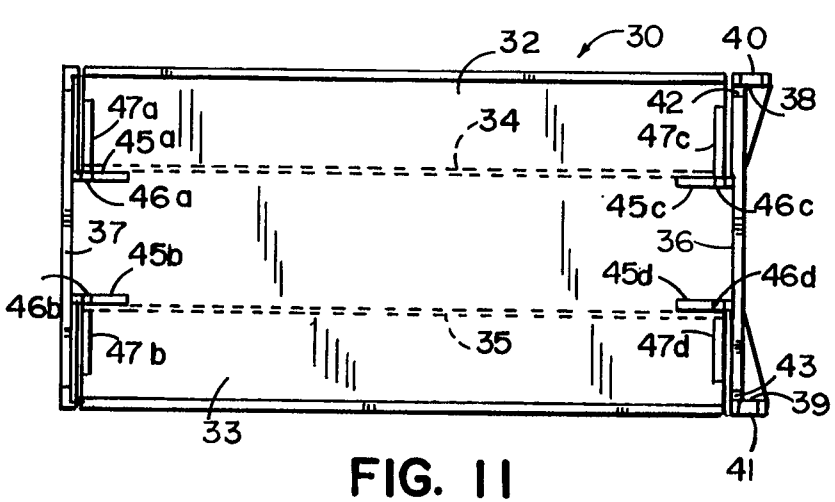
FIG. 11 is a bottom plan view of the cover/handle of FIG. 10.
Figure 9:
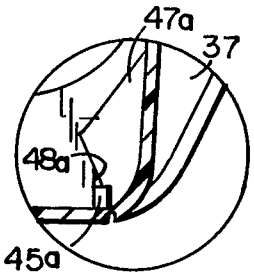
FIG. 9 is an enlarged cross-section of the encircled portion of the portion in FIG. 8.

Slots 42 and 43 (FIG. 11) are formed in the end wall 36 for receiving the ears 23 and 24 so that the ears can overlap each other. These slots form cammed surfaces over which outer round portions 25 of the ears 23 and 24 ride to hold the holder 10 and cover/handle 30 in open position (FIG. 6).

The unique and important part of this invention is the collapsible sides 32 and 33 which permits a handle for a rather large roller assembly to be reduced in size, particularly for persons who have smaller hands. In conjunction with this unique feature, I provide a means for limiting and retaining the collapsing of the sides 32 and 33 and also a means for automatically forcing the sides outwardly into the closed position of the cover/handle.

Figure 8:
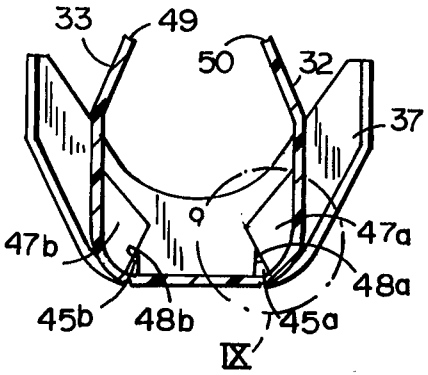
FIG. 8 is a cross-sectional view taken along the plane VIII—VIII of FIG. 7.
Figure 12:
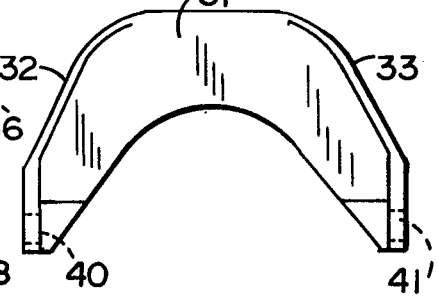
FIG. 12 is one side-elevational view of the cover/-handle of FIG. 10.
Figure 10:
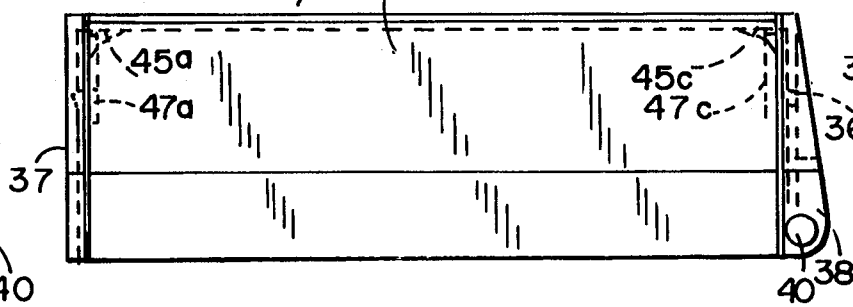
FIG. 10 is a side-elevational view of the cover/handle of the combination lint roller and encasement.
Figure 13:
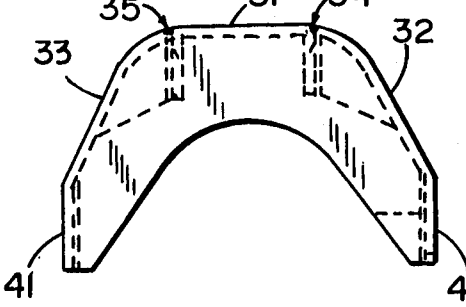
FIG. 13 is the other side-elevational view of the cover/handle of FIG. 10.

Reference is made to FIGS. 5, 6, 8, 9, 10, and 11 which best disclose the means for limiting and retaining the collapsing of sides 32 and 33. These figures disclose the stopper retaining elements 45*a*, 45*b*, 45*c*, and 45*d* extending from the side walls 36 and 37. Each of these stop retaining elements include a slot 46*a*, 46*b*, 46*c*, and 46*d*, respectively. Stop retaining flanges 47*a* and 47*c* are mounted on the side wall 32 in the position as disclosed in FIGS. 5, 6, 8, 9 and 11 aligned with slots 46*a* and 46*c*, respectively. Stop retaining flanges 47*b* and 47*d* are mounted on the sides 33 so as to be aligned with the slots 46*b* and 46*d*. As illustrated by FIG. 8, when the sides 32 and 33 are collapsed, the stop flanges 47*a* and 47*b* pass through the slots 46*a* and 46*b*, respectively, and engage the inclined surfaces 48*a* and 48*b*, respectively. Similarly, stop retaining flanges 47*c* and 47*d* pass through slots 46*c* and 46*d*. The dimensions of flanges 47*a*, 47*b*, 47*c*, and 47*d* are such that they engage the sides of the slots to hold the side sections of sides 32 and 33 by the friction between the slots and flanges. Thus, once the sides 32 and 33 are collapsed, the handle is given a rigid feel to the person operating the lint roller.

Figure 15:
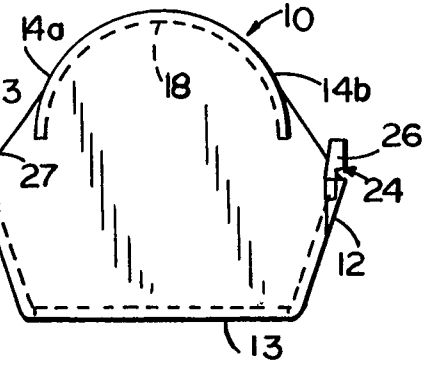
FIG. 15 is one end elevational view of the roller holder of FIG. 14.
Figure 16:
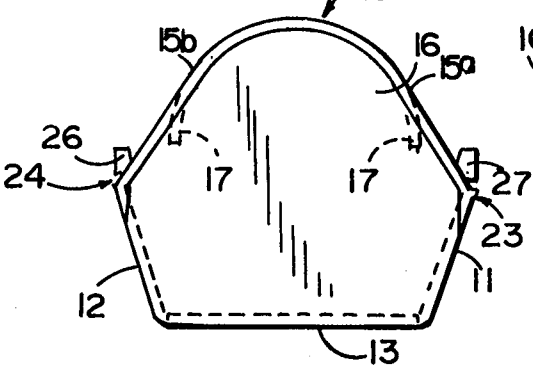
FIG. 16 is the other end-elevational view of the roller holder of FIG. 14.

As disclosed in FIGS. 15 and 16, the end walls 14 and 15 of roller holder 10 have tapered sides 14*a*, 14*b* and 15*a*, 15*b*, respectively, specifically for the purpose of camming the sides 32 and 33 from the collapsed position cf FIGS. 7 and 8 to the extended position of FIGS. 1–5. The inclined sides 14*a*, 14*b*, 15*a*, and 15*b* are purposely provided so that as the ends 49 and 50 (FIG. 8) engage the edges of the slanted sides 14*a* , 14*b*, 15*a*, 15*b*, the sides 32 and 33 are forced outwardly to the position as disclosed in FIG. 5. Thus, the sides are automatically restored to the closed position of FIG. 4 as the cover/handle is pivoted to the closed position of FIG. 5. When the cover/handle reaches the position as disclosed in FIG. 5, it is held in that position by the detent as identified by reference numeral 51 (FIG. 4).

OPERATION

Having described the details of this invention, the operation should become quite evident. The roller 2 is first placed into position between the two flanges 16 and 20. In this position, as disclosed in FIG. 7, the portion flanges 16 and 20 engage the ends of the roller with protrusions 17 and 18 extending into the openings 6 and 7, respectively, at the end of the roller 2. Once the roller 2 is in place, it can be freely turned about the protrusions 17 and 18 because of the relatively low friction on the surface of the flange portions 16 and 20. The handle/cover 30 is pivoted all the way open to the position of FIG. 7. In this position, the out-of-round portion 25 of the ears 23 and 24 have passed over the portion 44 which releasably retains the handle 30 in the position as disclosed in FIG. 7. In this position, when the operator grabs the handle/cover 30, the sides 32 and 33 collapse to a position as disclosed in FIG. 8 reducing the size of the handle and making its shape more comfortable for holding, particularly for a person with a small hand. The sides 32 and 33 are retained in the collapsed position by friction between the flanges 47*a*, 47*b*, 47*c*, and 47*d* and the sides of the slots 46*a*, 46*b*, 46*c*, and 46*d*. The operator then runs the roller 2 over the surface to be delinted.

When the use of the lint roller 2 is completed as the handle/cover is pivoted over the holder 10, the flanges 47*a*, 47*b*, 47*c*, and 47*d* are forced out of the slots 46*a*, 46*b*, 46*c*, and 46*d*, and the collapsed sides 32 and 33 of the handle/cover are cammed and guided open by the edges 49 and 50 engaging the slanted edges 14*a* , 14*b*, 15*a*, and 15*b* until the edges 49 and 50 of the ends of the sides 32 and 33 engage the top edges of the sides 11 and 12 of the roller holder. In this position, the cover/handle completely covers the roller 2 which is encased within the encasement provided by the roller holder 10 and cover 30. In this position, the detent 51 holds the cover securely on the holder 10 while, at the same time, making it possible to easily release the cover for use of the roller as above described.

Having described my invention, it should become evident that I provide a greatly improved lint roller, particularly of the type which is quite large and normally is difficult for one to operate because of the size of the handle/cover.

Although I have disclosed the preferred embodiment of this invention, it should become evident that there are other embodiments that could be made without departing from the spirit of this invention. Accordingly, the scope of my invention should be limited only as set forth in the appended claims.

The embodiments of the invention in which an exclusive property or privilege is claimed are defined as follows:

1. A combination of lint roller and an encasement therefor comprising:

first and second elongated clam shell elements pivotally connected together;

an adhesive roller formed into the shape of a tube with ends having cylindrical openings, said roller having a tacky outer surface for picking loose material off a surface upon contact therewith;

said first clam shell element including an elongated molded roller holder having a first base, a first pair of spaced side walls extending from the sides of said base, and a first pair of spaced end walls extending from ends of said base and connected between the ends of said first pair of spaced side walls;

means on said first pair of end walls for supporting said adhesive roller therebetween;

said second clam shell element including a cover/-handle having a second pair of side walls and a second pair of end walls connected between the ends of said second pair of side walls; said roller holder and cover/handle being pivotally connected together at one of each of the ends thereof to form an enclosure for said adhesive roller;

said first pair of side walls and first pair of end walls being shaped and dimensioned to engage said second pair of side walls and said second pair of ends walls, respectively, when said second clam shell element is pivoted to a closed position over said first clam shell element to thereby enclose said adhesive roller and when open, said second clam shell element providing a handle to grasp when operating the adhesive roller; and said pair of side walls of said second clam shell element having collapsible sections which are hinged and pivot inwardly so as to collapse and form a smaller and more comfortable handle to grasp when said handle is in the opened use position.

2. The device of claim 1 in which said second clam shell element is an integrally molded part and the collapsible sections are hinged by a living hinge.

3. The device of claim 1 in which said cover/handle includes non-collapsible portions and stop means is provided on said collapsible sections which engage said non-collapsible portions to limit the degree of collapsing of said sections of said side wall of said second clam shell element.

4. A combination of lint roller and an encasement therefor comprising:

first and second elongated clam shell elements pivotally connected together;

an adhesive roller formed into the shape of a tube with ends having cylindrical openings, said roller having a tacky outer surface for picking loose material off a surface upon contact therewith;

said first clam shell element including an elongated molded roller holder having a first base, a first pair of spaced side walls extending from the sides of said base, and a first pair of spaced end walls extending from ends of said base and connected between the ends of first pair of spaced side walls;

means on said first pair of end walls for supporting said adhesive roller therebetween;

said second clam shell element including a cover/-handle having a second pair of side walls and a second pair of end walls connected between the ends of said second pair of side walls; said roller holder and cover/handle being pivotally connected together at one of each of the ends thereof to form an enclosure for said adhesive roller;

said first pair of side walls and first pair of end walls being shaped and dimensioned to engage said second pair of side walls and said second pair of end walls, respectively, when said second clam shell element is pivoted to a closed position over said first clam shell element to thereby enclose said adhesive roller and when open, said second clam shell element providing a handle to grasp when operating the adhesive roller;

said pair of side walls of said second clam shell element having collapsible sections which are hinged and pivot inwardly so as to collapse and form a smaller and more comfortable handle to grasp when said handle is in the opened use position; and guide means engageable by the collapsible sections of said pair of side walls of said second clam shell element for opening said sections when the second clam shell element is pivoted to the closed position over said first clam shell element.

5. The device of claim 4 in which said guide means for opening said collapsible sections comprises cam means on the end walls of said first clam shell element which engage portions of said collapsible sections of said side walls of said second clam shell element.

6. The device of claim 5 in which said collapsible sections have free ends and the cam means is slanted edges of said end walls of said first clam shell element which are engaged by the free ends of said collapsible sections of said side walls of said second clam shell element.

7. A combination of lint roller and an encasement therefor comprising:

first and second elongated clam shell elements pivotally connected together;

an adhesive roller formed into the shape of a tube with ends having cylindrical openings, said roller having a tacky outer surface for picking loose material off a surface upon contact therewith;

said first clam shell element including an elongated molded roller holder having a first base, a first pair of spaced side walls extending from the sides of said base, and a first pair of spaced end walls extending from ends of said base and connected between the ends of said first pair of spaced side walls;

means on said first pair of end walls for supporting said adhesive roller therebetween;

said second clam shell element including a cover/-handle having a second pair of side walls and a second pair of end walls connected between the ends of said second pair of side walls; said roller holder and cover/handle being pivotally connected together at one of each of the ends thereof to form an enclosure for said adhesive roller;

said first pair of side walls and first pair of end walls being shaped and dimensioned to engage said second pair of side walls and said second pair of end walls, respectively, when said second clam shell element is pivoted to a closed position over said first clam shell element to thereby enclose said adhesive roller and when open, said second clam shell element providing a handle to grasp when operating the adhesive roller;

said pair of side walls of said second clam shell element having collapsible sections which are hinged and pivot inwardly so as to collapse and form a smaller and more comfortable handle to grasp when said handle is in the opened use position;

said cover/handle including non-collapsible portions and stop means provided on said collapsible sections which engage said non-collapsible portions to limit the degree of collapsing of said sections of said side walls of said second clam shell element, said stop means including cooperative stop elements, at least one on stop element on said collapsible sections of said second clam shell element and at least one of said stop elements on at least one of said end walls of said second clam shell element.

8. The device of claim 7 in which said stop elements are flanges located on orthogonal planes, said flanges being adapted to engage each other to limit and control the degree of collapsing of said collapsible sections.

9. The device of claim 8 in which said stop element on said at least one of said end walls of said second clam shell element includes a flange having a slot and a stop surface and said at least one stop element on said collapsible sections of said second clam shell element includes a flange aligned with and adapted to pass through said slot and engage said stop surface.

10. The device of claim 9 in which said cover/handle is an integrally molded part and the collapsible sections are pivoted by a living image.

11. The device of claim 7 in which said stop elements engage each other to releasably retain said collapsible sections of said side walls of said second clam shell element in a collapsed position.

12. In an encased lint roller having an adhesive roller, a roller holder and a cover with means for providing pivotal movement of said cover relative to said holder from a closed position to an open position at which said cover provides a handle to manipulate said lint roller; the improvement comprising:

said cover having side walls with collapsible pivotable side sections which are collapsed when grasped by the hand of a user so as to form a smaller and more comfortable handle to grasp when said cover is in the open use position.

13. The device of claim 12 in which said cover includes non-collapsible portions; and stop means is provided on said collapsible sections which engage said non-collapsible portions to limit the degree of collapsing of said side sections.

14. In an encased lint roller having an adhesive roller, a roller holder and a cover with means for providing pivotal movement of said cover relative to said holder from a closed position to an open position at which said cover provides a handle to manipulate said lint roller; the improvement comprising:

said cover having side walls with collapsible pivotable side sections which are collapsed when grasped by the hand of a user so as to form a smaller and more comfortable handle to grasp when said cover is in the open use position; and guide means engageable by the collapsible pivotable side sections for opening said collapsible sections as said cover is pivoted from the open to the closed position over said holder.

15. The device of claim 14 in which said roller holder includes end walls, and said guide means for opening said collapsible sections comprises cam means on said end walls of said roller holder which engage portions of said side sections.

16. The device of claim 15 in which said collapsible sections include free ends and the cam means comprises slanted edges of said end walls which are engaged by the free ends of said collapsible sections of said side walls.

17. In an encased lint roller having an adhesive roller, a roller holder and a cover with means for providing pivotal movement of said cover relative to said holder from a closed position to an open position at which said cover provides a handle to manipulate said lint roller; the improvement comprising;

said cover having side walls with collapsible pivotable side sections which are collapsed when grasped by the hand of a user so as to form a smaller and more comfortable handle to grasp when said cover is in the open use position;

stop means provided to limit the degree of collapsing of said side sections;

said cover including end walls, and said stop means includes a cooperative stop element on each of said side walls of said cover and on one of said end walls of said cover.

18. The device of claim 17 in which said stop elements engage each other to releasably retain said side sections in the collapsed position.

19. The device of claim 17 in which said stop elements are flanges located on orthogonal planes, said flanges being adapted to limit and control the degree of collapsing of said side sections.

20. The device of claim 19 in which said stop element on one of said end walls of said cover includes a flange having a slot and a stop surface and each of said stop elements on said side walls of said cover includes a flange aligned with an adapted to pass through said slot and engage said stop surface when said side sections are collapsed.

* * * * *

UNITED STATES PATENT AND TRADEMARK OFFICE

CERTIFICATE OF CORRECTION

PATENT NO. : 5,333,341

DATED : August 2, 1994

INVENTOR(S) : William R. Heneveld

It is certified that error appears in the above-indentified patent and that said Letters Patent is hereby corrected as shown below:

Column 2, line 34:
"and &" should be --and 7--.

Column 7, claim 10, line 22:
"image" should be --hinge--.

Signed and Sealed this

Twenty-eight Day of February, 1995

Bruce Lehman

*Attest:*

BRUCE LEHMAN

*Attesting Officer*

*Commissioner of Patents and Trademarks*